US006461729B1

(12) United States Patent
Dugan

(10) Patent No.: US 6,461,729 B1
(45) Date of Patent: Oct. 8, 2002

(54) SPLITTABLE MULTICOMPONENT POLYOLEFIN FIBERS

(75) Inventor: Jeffrey S. Dugan, Erwin, TN (US)

(73) Assignee: Fiber Innovation Technology, Inc., Johnson City, TN (US)

( * ) Notice: Subject to any disclaimer, the term of this patent is extended or adjusted under 35 U.S.C. 154(b) by 0 days.

(21) Appl. No.: 09/371,301

(22) Filed: Aug. 10, 1999

(51) Int. Cl.[7] ..... D01F 8/00
(52) U.S. Cl. ..... 428/373; 428/374
(58) Field of Search ..... 428/397, 400, 428/364, 373, 374

(56) References Cited

U.S. PATENT DOCUMENTS

| | | | | |
|---|---|---|---|---|
| 4,874,399 A | | 10/1989 | Reed et al. | |
| 4,988,560 A | | 1/1991 | Meyer et al. | |
| 5,069,970 A | | 12/1991 | Largman et al. | |
| 5,157,092 A | | 10/1992 | Asanuma et al. | |
| 5,445,884 A | * | 8/1995 | Hoyt et al. | 428/370 |
| 5,456,982 A | * | 10/1995 | Hansen et al. | 428/370 |
| 5,458,972 A | * | 10/1995 | Hagen | 428/313 |
| 5,580,644 A | * | 12/1996 | Minami | 428/397 |
| 5,586,997 A | | 12/1996 | Pall et al. | |
| 5,597,645 A | | 1/1997 | Pike et al. | |
| 5,656,368 A | | 8/1997 | Braun et al. | |
| 5,759,926 A | * | 6/1998 | Pike et al. | 428/397 |
| 5,783,503 A | | 7/1998 | Gillespie et al. | |
| 5,785,725 A | | 7/1998 | Cusick et al. | |
| 5,792,242 A | | 8/1998 | Haskett | |
| 5,795,369 A | | 8/1998 | Taub | |
| 5,935,883 A | * | 8/1999 | Pike | 442/340 |
| 5,948,528 A | * | 9/1999 | Helm | 428/373 |

FOREIGN PATENT DOCUMENTS

| | | |
|---|---|---|
| JP | 03137222 A | 6/1991 |
| JP | 03199425 A | 8/1991 |
| JP | 05146614 A | 6/1993 |

* cited by examiner

*Primary Examiner*—N. Edwards
(74) *Attorney, Agent, or Firm*—Alston & Bird LLP

(57) ABSTRACT

Mechanically divisible multicomponent fibers are disclosed having at least a first component comprised of a branched alkyl olefin polymer and at least a second component comprised of a straight-chain alkyl olefin polymer. The multicomponent fibers are particularly useful in the manufacture of nonwoven structures, and in particular nonwoven structures used as filter media.

17 Claims, 4 Drawing Sheets

SPLITTABLE MULTICOMPONENT POLYOLEFIN FIBERS

FIELD OF THE INVENTION

The present invention is related to fine denier polyolefin fibers. In particular, the invention is related to fine denier polyolefin fibers obtained by splitting multicomponent polyolefin fibers and to fabrics made from such fine fibers.

BACKGROUND OF THE INVENTION

Filtration processes are used to separate compounds of one phase from a fluid stream of another phase by passing the fluid stream through filtration media, or septum, which traps the entrained or suspended matter. The fluid stream may be either a liquid stream containing a solid particulate or a gas stream containing a liquid or solid aerosol. Properties considered in selecting a particular filtration media include the ability of the media to retain particulates to be filtered out of the fluid, chemical resistance, physical strength to withstand filtering conditions, and cost.

Common filtration media include fabrics formed of natural, synthetic, metallic and glass fibers. For use in corrosive environments, filters are typically formed of fibers having chemical resistance. Examples of polymers having chemical resistance include polyolefins, such as polyethylene and polypropylene, and fluoropolymers, such as polytetrafluoroethylene. For example, polypropylene fabrics are beneficial for use as septum in a wide range of applications because such fabrics are economical, insensitive to moisture, have adequate tensile properties, are able to retain an electrical charge, and have superior chemical resistance. For a more detailed discussion of various filtration applications employing polypropylene nonwoven fabric, reference is made to U.S. Pat. No. 5,586,997 directed bag filters; U.S. Pat. No. 5,795,369 directed to mist eliminators; and U.S. Pat. Nos. 5,597,645 and 5,792,242, both directed to electret filters. See also U.S. Pat. No. 4,874,399, reporting additional benefits of a polypropylene blend in electret filter applications.

A wide range of fabric constructions can be used in filtration media, including woven, knit, and nonwoven fabrics. For example, meltblown and melt spun nonwoven webs have been used as septum. Exemplary melt spun webs include carded fiber webs, air-laid fiber webs, wet-laid fiber webs and spunbond fiber webs.

Fine denier fibers in filtration media can provide benefits in the filtration of extremely small particulates. Fine denier fibers may be used to produce fabrics having smaller pore sizes, thus allowing smaller particulates to be filtered from a fluid stream. In addition, fine denier fibers can provide a greater surface area per unit weight of fiber, which can be beneficial in filtration applications.

Meltblown technology is one avenue by which to produce fabric from fine denier filaments. Fine denier meltblown webs have been widely employed as filter media because the densely packed fibers of these webs are conducive for providing high filter efficiency. However, meltblown webs typically do not have good physical strength, primarily because less orientation is imparted to the polymer during processing and lower molecular weight resins are employed. Thus, in general, meltblown filter media are laminated to at least one separate, self-supporting layer, which adds cost and complexity to the manufacturing process.

Melt extrusion processes can provide higher strength fibers than meltblown fibers. However, it is difficult to produce fine denier fibers, in particular fibers of 2 denier or less, using conventional melt extrusion processes. Therefore, while filter media produced from nonwoven webs of coarser fibers, such as spunbond and staple fiber webs, have been used in filtration applications such as stove hood filters, they have not been used as filter media for fine particles.

One avenue by which to overcome this difficulty in melt extrusion is to split multicomponent continuous filament or staple fiber into fine denier filaments, or microfilaments, in which each fine denier filament has only one polymer component. Multicomponent fibers, also referred to as composite fibers, may be split into fine fibers comprised of the respective components, if the composite fiber is formed from polymers which are incompatible in some respect. The single composite filament thus becomes a bundle of individual component microfilaments. See, for example, U.S. Pat. Nos. 5,783,503 and 5,759,926, reporting splittable multicomponent fibers containing polypropylene, such as splittable polyester/polypropylene and nylon/polypropylene fibers.

A number of processes are known for separating the fine denier filaments from multicomponent fibers. The particular process employed depends upon the specific combination of components comprising the fiber, as well as their configuration. One common process by which to divide a multicomponent fiber involves mechanically working the fiber. Methods commonly employed to work the fiber include drawing on godet rolls, beating or carding. It is also known that fabric formation processes such as needle punching or hydroentangling may supply sufficient energy to a multicomponent fiber to effect separation. When mechanical action is used to separate multicomponent fibers, the fiber components must be selected to bond poorly with each other to facilitate subsequent separation. In that vein, conventional opinion has been that the polymer components must differ from each other significantly to ensure minimal interfilamentary bonding. It is for this reason that polymers having disparate chemistries, i.e., from different chemical families, have been chosen as components for mechanically dissociable composite fibers to date.

However, the use of such disparate chemistries is problematic, as polymers from different chemical families generally have physical properties which differ significantly, such as chemical resistance. As an example, when filtering corrosive fluids using fabric formed from polyester/polypropylene multicomponent fiber, the polyester component will readily degrade, while the polypropylene component will withstand the chemical attack.

Based on the foregoing, although a number of methods for splitting multicomponent fibers containing polyolefin components to obtain fine denier filaments are known, there is still need for improvement.

SUMMARY OF THE INVENTION

The present invention provides splittable multicomponent polyolefin fibers and fiber bundles which include a plurality of fine denier polyolefin filaments having many varied applications in the textile and industrial sector. The fibers can exhibit many advantageous properties, such as a high surface area per weight, chemical resistance, a soft silk-like hand, and the like. The present invention further provides fabrics formed of the multicomponent fibers and fiber bundles, as well as an economical process by which to produce fine denier polyolefin filaments.

In particular, the invention provides mechanically divisible or splittable fibers formed of polyolefin components.

The fibers can have a variety of configurations, including pie/wedge fibers, segmented round fibers, segmented oval fibers, segmented rectangular fibers, segmented ribbon fibers, and segmented multilobal fibers. Further, the mechanically splittable multicomponent fibers can be in the form of continuous filaments, staple fibers, or meltblown fibers. The splittable fibers may be dissociated by a variety of mechanical actions, such as impinging with high pressure water, carding, crimping, drawing, and the like.

In one particularly advantageous aspect of the invention, the divisible multicomponent fiber includes at least one polyolefin component containing branched alkyl radicals, advantageously poly(4-methyl-1-pentene) (PMP), and at least one polyolefin component containing straight-chain alkyl radicals, advantageously polypropylene (PP). The polymer components are dissociable by mechanical means to form a bundle of fine denier polyolefin fibers. A particularly advantageous embodiment is a splittable multicomponent fiber formed of poly(4-methyl-1-pentene) and polypropylene in a pie/wedge configuration.

The instant invention also provides a fiber bundle which includes a plurality of dissociated polyolefin microfibers of different polyolefin compositions. Specifically the fiber bundle includes a plurality of branched alkyl polyolefin microfilaments, advantageously poly(4-methyl-1-pentene) microfilaments, and straight-chain alkyl polyolefin microfilaments, advantageously polypropylene. In general, the microfilaments of the present invention range in size from 0.05 to 1.5 denier.

The multicomponent fibers can be formed into a variety of textile structures, including nonwoven webs, either prior to or after fiber dissociation. Fabrics made using the fine denier fibers of the present invention are both economical to produce and behave in important ways as fabrics made entirely of polyolefin. As noted previously, earlier fabrics containing mechanically splittable composite filaments were based on disparate component chemistries. A typical conventional fabric produced from mechanically splittable composite fibers includes polypropylene (PP) and polyethylene terephthalate (PET) microfilaments. As noted previously, PET/PP fabrics are not recommended for use as filters for in corrosive environments, because the PET microfilaments degrade, thereby destroying filtration properties. In addition to loss of filtration performance of the dissolved PET fiber, the filtered stream can be contaminated with the PET decomposition products. In contrast, a filter entirely from fine denier polyolefin fibers, such as poly(4-methyl-1-pentene) and polypropylene, would be expected to withstand a broad range of chemical attack for an extended period of time.

However, previous attempts to overcome this difficulty by making mechanically splittable fibers from polyolefins have failed, because most polyolefins have too high an affinity for each other to allow the segments to be split easily. Surprisingly, the inventors have found that a branched alkyl polyolefin polymer, advantageously poly(4-methyl-1-pentene), can be made into a readily splittable segmented melt spun fiber with straight-chain alkyl polyolefins such as polypropylene. The resulting composite fiber has desirable chemical resistance and tensile properties in comparison to comparable fibers produced by melt blowing.

Another aspect of the invention teaches fabrics formed from mechanically splittable multicomponent fibers formed from branched alkyl and straight-chain alkyl polyolefin components, as well as the methods by which to produce such fabrics. In this aspect of the invention, the multicomponent fibers can be divided into microfilaments prior to, during, or following fabric formation. Fabrics of the present invention may generally be formed by weaving, knitting, or nonwoven processes. Advantageously the fabric is a dry-laid nonwoven fabric formed from the multicomponent fibers of the present invention. Another advantageous fabric is a dry-laid nonwoven fabric bonded by hydroentangling.

Products comprising the fabrics of the present invention provide further advantageous embodiments. Particularly preferred products include filtration media, including bag filters, electret filters, and mist eliminators. Filtration media for severe service conditions, in particular corrosive environments, is also provided.

By providing fiber bundles comprised entirely of fine denier polyolefin filaments, the present invention permits soft fabrics having a high degree of coverage to be economically produced. In specific, the multiconstituent fibers of the present invention allow the production of fabrics containing fine denier polyolefin filaments for use in filtration, particularly the filtration of corrosive materials.

Further understanding of the processes and systems of the invention will be understood with reference to the brief description of the drawings and detailed description which follows herein.

DETAILED DESCRIPTION OF THE INVENTION

The present invention will be described more fully hereinafter in connection with illustrative embodiments of the invention which are given so that the present disclosure will be thorough and complete and will fully convey the scope of the invention to those skilled in the art. However, it is to be understood that this invention may be embodied in many different forms and should not be construed as being limited to the specific embodiments described and illustrated herein. Although specific terms are used in the following description, these terms are merely for purposes of illustration and are not intended to define or limit the scope of the invention. As an additional note, like numbers refer to like elements throughout.

Referring now to FIG. 1, cross sectional views of exemplary multicomponent fibers of the present invention are provided. The multicomponent fibers of the invention, designated generally as 4, include at least two structured polymeric components, a first component 6, advantageously comprised of poly(4-methyl-1-pentene) and a second component 8, advantageously comprised of polypropylene.

In general, multicomponent fibers are formed of two or more polymeric materials which have been extruded together to provide continuous contiguous polymer segments which extend down the length of the fiber. For purposes of illustration only, the present invention will generally be described in terms of a bicomponent fiber. However, it should be understood that the scope of the present invention is meant to include fibers with two or more components. In addition, the term "fiber" as used herein means both fibers of finite length, such as conventional staple fiber, as well as substantially continuous structures, such as filaments, unless otherwise indicated.

Figure 1A:
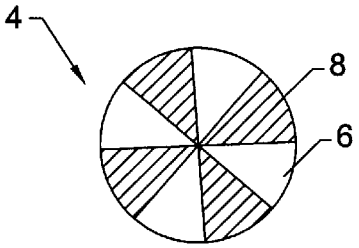
FIGS. 1A–1E are cross sectional views of exemplary embodiments of multicomponent fibers in accordance with the present invention.
Figure 1B:
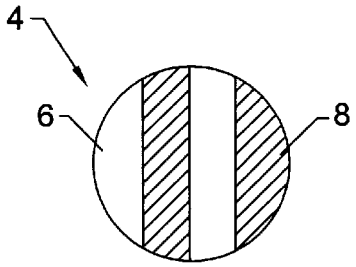
Figure 1C:
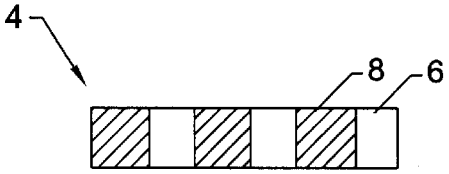
Figure 1D:
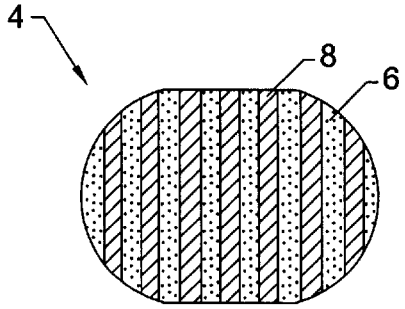
Figure 1E:
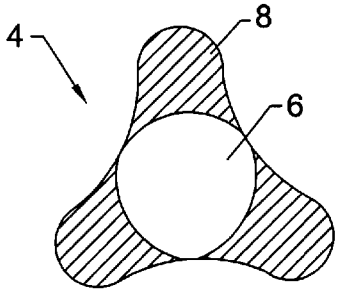

As illustrated in FIGS. 1A–1E, a wide variety of fiber configurations that allow the polymer components to be free to dissociate are acceptable. Typically, the fiber components are arranged so as to form distinct unocclusive cross-sectional segments along the length of the fiber so that none of the components is physically impeded from being separated. One advantageous embodiment of such a configuration is the pie/wedge arrangement, shown in FIG. 1A. The pie/wedge fiber can be a hollow or non-hollow fiber. In particular, FIG. 1A provides a bicomponent filament having eight alternating segments of triangular shaped wedges of poly(4-methyl-1-pentene) components 6 and polypropylene components 8. It should be recognized that more than eight or less than eight segments can be produced in filaments made in accordance with the invention. Other fiber configurations as known in the art may be used, such as but not limited to, the segmented configuration shown in FIG. 1B. Reference is made to U.S. Pat. No. 5,108,820 to Kaneko et al., U.S. Pat. No. 5,336,552 to Strack et al., and U.S. Patent No. 5,382,400 to Pike et al. for a further discussion of multicomponent fiber constructions.

Further, the multicomponent fibers need not be conventional round fibers. Other useful shapes include the segmented rectangular configuration shown in FIG. 1C, the segmented oval configuration in FIG. 1D, and the multilobal configuration of FIG. 1E.

Such unconventional shapes are further described in U.S. Pat. No. 5,277,976 to Hogle et al., and U.S. Pat. Nos. 5,057,368 and 5,069,970 to Largman et al.

Both the shape of the fiber and the configuration of the components therein will depend upon the equipment which is used in the preparation of the fiber, the process conditions, and the melt viscosities of the two components. A wide variety of fiber configurations are possible. As will be appreciated by the skilled artisan, typically the fiber configuration is chosen such that one component does not encapsulate, or only partially encapsulates, other components.

Further, to provide dissociable properties to the composite fiber, the polymer components are chosen so as to be mutually incompatible. In particular, the polymer components do not substantially mix together or enter into chemical reactions with each other. Specifically, when spun together to form a composite fiber, the polymer components exhibit a distinct phase boundary between them so that substantially no blend polymers are formed, preventing dissociation. In addition, a balance of adhesion/incompatibility between the components of the composite fiber is considered highly beneficial. The components advantageously adhere sufficiently to each other to allow the unsplit multicomponent fiber to be subjected to conventional textile processing such as winding, twisting, weaving, or knitting without any appreciable separation of the components until desired. Conversely, the polymers should be sufficiently incompatible so that adhesion between the components is sufficiently weak, thereby allowing ready separation upon the application of sufficient external force.

Both components of the fibers of the invention are classified as polyolefins. In general, polyolefin polymers are formed from the addition reaction of alkene monomers. Alpha olefins are alkenes which have a double bond between their first and second carbon atoms. In general, polyolefin polymer chains grow by reacting across an alpha double bond site of a monomer. Subsequent to its addition to the chain, the third and higher hydrocarbons in the monomer molecule rotate away from the main polymer chain, thereby forming pendant alkyl groups. For the purposes of the present invention, branched alkyl polyolefins are defined as those polyolefin polymers in which a branched alkyl pendant group, defined as having more than one methyl moiety, is created upon the addition of each monomer unit. Similarly, straight-chain alkyl polyolefin polymers are defined as those polyolefin polymers which do not have a branched pendant group arising upon the addition of each monomer unit, and which may be generally characterized as having either a singe methyl moiety at the terminus of the pendant group or no pendant group.

At least one component of the fibers of the invention includes a branched alkyl polyolefin polymer. A particularly advantageous branched alkyl polyolefin polymer is poly(4-methyl-1-pentene) (PMP), also commonly referred to as poly 4-methylpentene or poly-4-methylpentene-1. Further examples of branched alkyl polyolefins which may be useful in the present invention include without limitation fiber forming polymers formed from 3-methylbutene-1 and 4,4-dimethylpentene-1, and the like as well as copolymers, terpolymers and mixtures thereof.

PMP is particularly attractive for use in the present invention because it is a polyolefin resin having good heat and chemical resistance. In addition, the use of poly(4-methyl-1-pentene) in splittable fibers is advantageous because PMP develops tensile properties which are comparable to the polyolefin polymers traditionally employed in fiber formation. Reference is also made to PMP with improved fiber properties, disclosed in U.S. Pat. No. 5,157,092 to Asanuma et al., the entire disclosure of which is hereby incorporated by reference. A particularly advantageous PMP is TPX RT-18, available from Mitsui Chemicals, Inc.

At least one other component of the fibers of the invention includes a straight-chain alkyl polyolefin polymer. Suitable straight-chain akyl olefin polymers include without limitation polymers such as polyethylene, polypropylene, poly-1-butene, poly-1-pentene, poly-1-hexene, poly-1-octene, polybutadiene, poly-1,7-octadiene, and poly 1,4-hexadiene, and the like, as well as copolymers, terpolymers and mixtures thereof. Polyethylene, polypropylene, and poly-1-butene are considered to be particularly advantageous. Polypropylene (PP) is particularly preferred. Polypropylene is commercially available from many manufacturers, including Fina Oil and Chemical Co.

Each of the polymeric components can optionally include other components not adversely affecting the desired properties thereof. Exemplary materials which could be used as additional components would include, without limitation, antioxidants, stabilizers, particulates, and other materials added to enhance processability of the first and/or the second components. In particular, it is known in the art to use antioxidants and ultraviolet light absorbers in the production of polypropylene. Further, the use of pigments is known in polyolefin polymers. The same pigment may be employed in both the components, or, in an alternative embodiment, the components may each contain pigments of differing colors. These and other additives can be used in conventional amounts. The weight ratio of the branched alkyl polyolefin component and the straight-chain alkyl polyolefin component can vary. Preferably the weight ratio is in the range of about 10:90 to 90:10, more preferably from about 20:80 to about 80:20, and most preferably from about 35:65 to about 65:35. In addition, the dissociable multicomponent fibers of the invention can be provided as staple fibers, continuous filaments, or meltblown fibers.

In general, staple, multi-filament, and spunbond multicomponent fibers formed in accordance with the present invention can have a fineness of about 0.5 to about 100 denier. Meltblown multicomponent filaments can have a fineness of about 0.001 to about 10.0 denier. Monofilament multicomponent fibers can have a fineness of about 50 to about 10,000 denier. Denier, defined as grams per 9000 meters of fiber, is a frequently used expression of fiber diameter. A lower denier indicates a finer fiber and a higher denier indicates a thicker or heavier fiber, as is known in the art.

Dissociation of the multicomponent fibers provides a plurality of fine denier filaments or microfilaments, each formed of the different polymer components of the multicomponent fiber. As used herein, the terms "fine denier filaments" and "microfilaments" include sub-denier filaments and ultra-fine filaments. Sub-denier filaments typically have deniers in the range of 1 denier per filament or less. Ultra-fine filaments typically have deniers in the range of from about 0.1 to 0.3 denier per filament. As discussed previously, fine denier filaments of low orientation have previously been obtained from relatively low molecular weight polymers by meltblowing. The present invention provides fine denier polyolefin meltspun filament having higher tensile properties than previously available. In addition, the invention provides continuous fine denier polyolefin filaments produced at commercial throughputs with acceptable manufacturing yields.

Figure 2B:
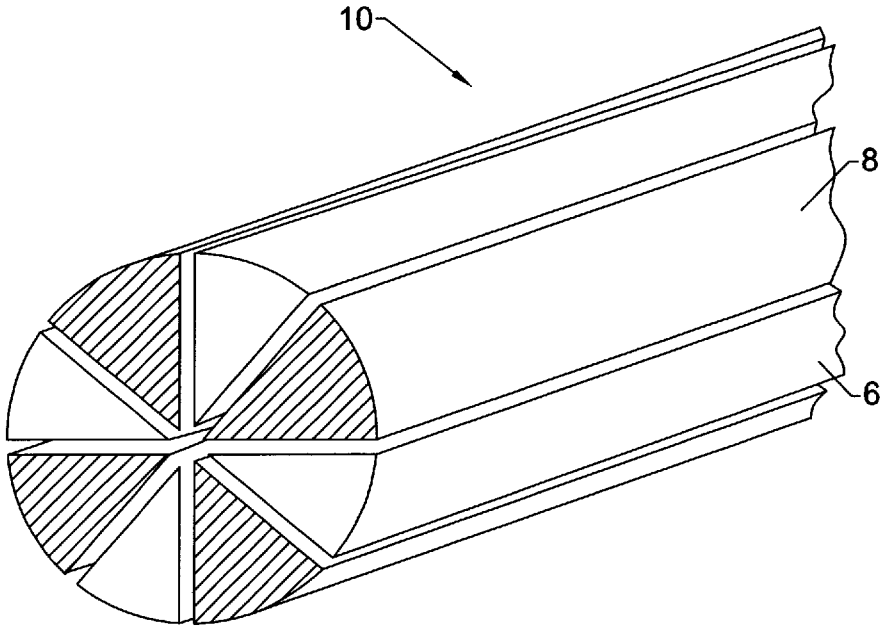
FIGS. 2A and 2B are cross sectional and longitudinal views, respectively, of an exemplary dissociated fiber in accordance with one embodiment of the present invention.
Figure 2A:
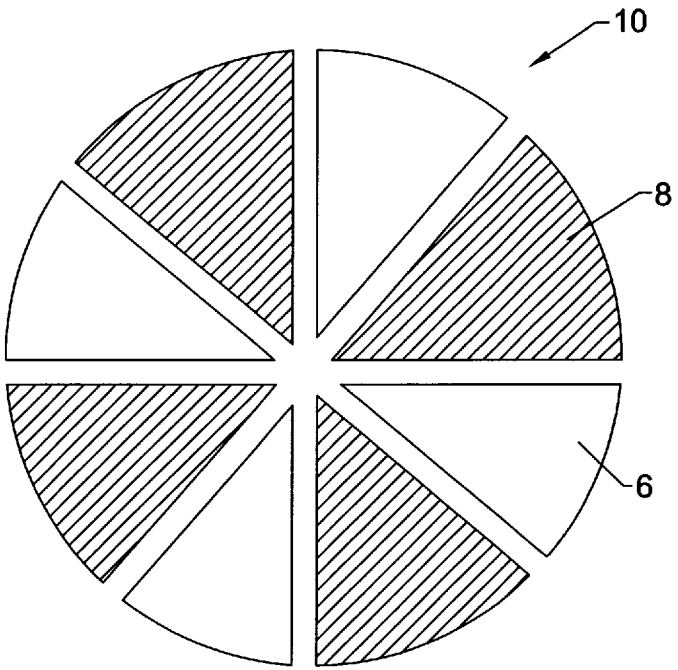

FIG. 2 illustrates an exemplary multicomponent fiber of the present invention which has been separated into a fiber bundle 10 of microfilaments as described above. In the illustrated example, the multicomponent fiber has been divided into four poly(4-methyl-1-pentene) microfilaments 6 and four polypropylene microfilaments 8, thereby providing an eight filament fiber bundle. In a typical example, a multicomponent fiber having 4 to 48, preferably 8 to 20, segments is produced. Generally, the tenacity of the multicomponent fiber ranges from about 1.5 to about 4 grams/denier (gpd). A typical range of tenacity for both the poly(4-methyl-1-pentene) microfilaments and/or polypropylene fine denier filaments produced in accordance with the present invention is also about 1.5 to about 4 gpd. Grams per denier, a unit well known in the art to characterize fiber tensile strength, refers to the force in grams required to break a given filament or fiber bundle divided by that filament or fiber bundle's denier. As used herein, the term "microfilaments" refers to both continuous filaments and staple fibers.

It was altogether unexpected that this particular combination of polymer components would readily dissociate when subjected to sufficient mechanical action. Heretofore, mechanically divisible fibers have been comprised of widely differing polymer types to ensure adequate dissociation. It is surprising that the multicomponent fibers of the present invention, comprised of components from the same chemical family, namely polyolefin, would be capable of splitting into fine denier component filaments. While not wishing to be bound by any theory, it is believed that, although both components are polyolefins, the difference in pendant alkyl chain character between the components gives rise to sufficient incompatibility to allow mechanical splitting to occur.

The multicomponent fibers of the present invention may be dissociated into separate branched alkyl polyolefin microfilaments (such as PMP microfilaments) and straight-chain alkyl polyolefin microfilaments (such as PP microfilaments) by any means that provides sufficient flex or mechanical action to the fiber to fracture and separate the components of the composite fiber. As used herein, the terms "splitting," "dissociating," or "dividing" mean that at least one of the fiber components is separated completely or partially from the original multicomponent fiber. Partial splitting can mean dissociation of some individual segments from the fiber, or dissociation of pairs or groups of segments, which remain together in these pairs or groups, from other individual segments, or pairs or groups of segments from the original fiber. As illustrated in FIG. 2, the resultant fine denier components can remain in proximity to the remaining components, thereby providing a coherent fiber bundle 10 of fine denier poly(4-methyl-1-pentene) microfilaments 6 and polypropylene microfilaments 8 originating from a common multicomponent fiber. However, as the skilled artisan will appreciate, in some processing techniques, such as hydroentanglement, or where the fibers are split prior to fabric formation, the fibers originating from a common fiber source may be further removed from one another.

Figure 3:
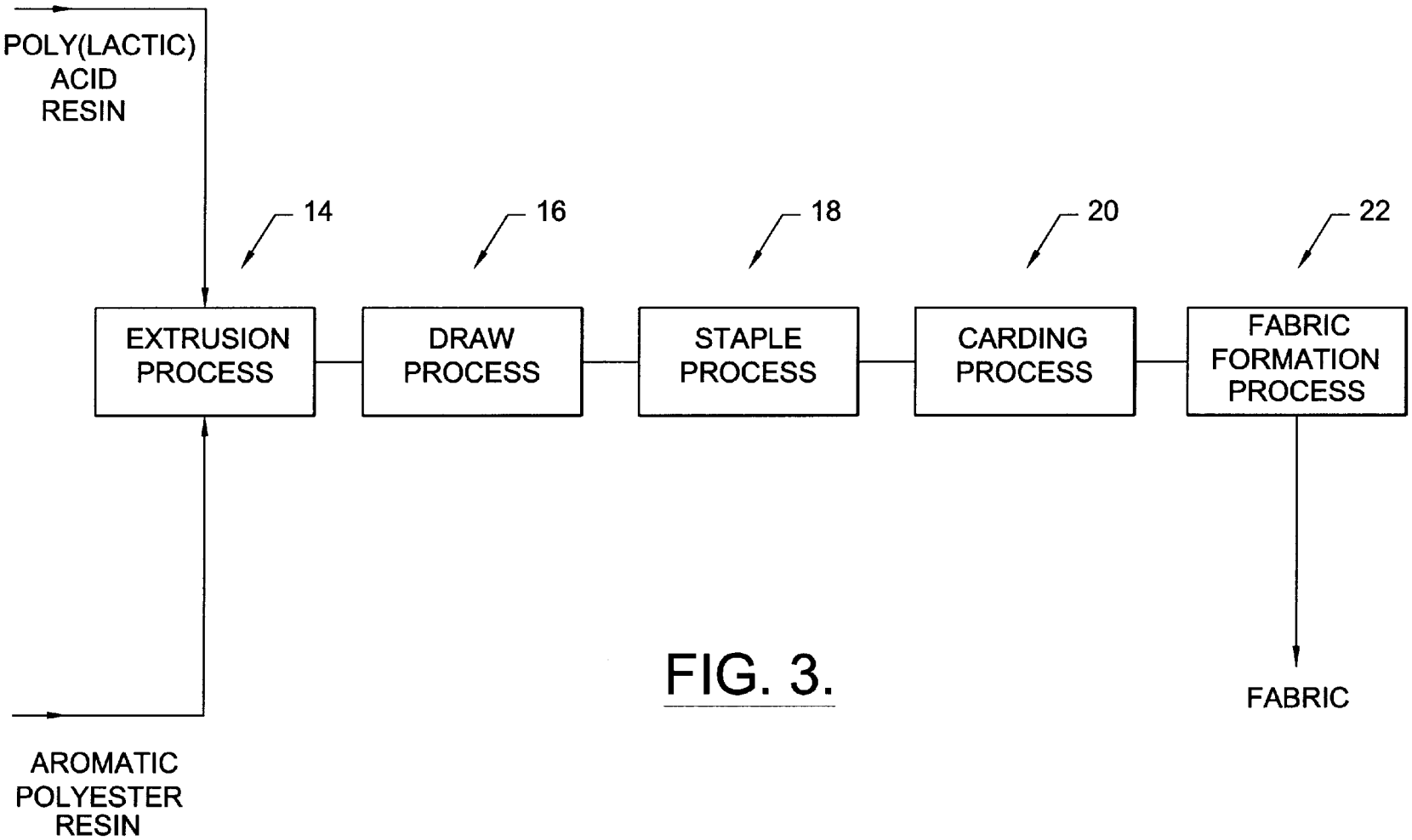
FIG. 3 is a flow diagram illustrating a fabric formation process according to one embodiment of the present invention.

Turning now to FIG. 3, an exemplary process for making a fabric in accordance with one embodiment of the invention is illustrated. Specifically, FIG. 3 illustrates an extrusion process 14, followed by a draw process 16, a staple process 18, a carding process 20, and a fabric formation process 22.

The extrusion process 14 for making multicomponent continuous filament fibers is well known and need not be described here in detail. Generally, to form a multicomponent fiber, at least two polymers are extruded separately and fed into a polymer distribution system wherein the polymers are introduced into a spinneret plate. The polymers follow separate paths to the fiber spinneret and are combined in a spinneret hole. The spinneret is configured so that the extrudant has the desired overall fiber cross section (e.g., round, trilobal, etc.). Such a process is described, for example, in Hills U.S. Pat. No. 5,162,074, the contents of which are incorporated herein by reference in their entirety.

In the present invention, a branched alkyl polyolefin polymer, such as PMP, and a straight-chain alkyl polyolefin polymer, such as PP, are fed into the polymer distribution system. In one advantageous embodiment, a poly(4-methyl-1-pentene) polymer stream and a polypropylene stream are employed. The polymers typically are selected to have melting temperatures such that the polymers can be spun at a polymer throughput that enables the spinning of the components through a common capillary at substantially the same temperature without degrading one of the components.

Following extrusion through the die, the resulting thin fluid strands, or filaments, remain in the molten state for some distance before they are solidified by cooling in a surrounding fluid medium, which may be chilled air blown through the strands. Once solidified, the filaments are taken up on a godet or other take-up surface. In a continuous filament process, the strands are taken up on a godet which draws down the thin fluid streams in proportion to the speed of the take-up godet. Continuous filament fiber may further be processed into staple fiber. In processing staple fibers, large numbers, e.g., 10,000 to 1,000,000 strands, of continuous filament are gathered together following extrusion to form a tow for use in further processing, as is known in that art.

Rather than being taken up on a godet, continuous multicomponent fiber may also be melt spun as a direct laid nonwoven web via a jet process. For example, in spunbonding process, the strands are collected in a jet following extrusion through the die, such as for example, an air attenuator, and then blown onto a take-up surface such as a roller or a moving belt to form a spunbond web. As an alternative, direct laid composite fiber webs may be prepared by a meltblown process, in which air is ejected at the surface of a spinneret to simultaneously draw down and cool the thin fluid polymer streams which are subsequently deposited on a take-up surface in the path of cooling air to form a fiber web.

Regardless of the type of melt spinning procedure which is used, typically the thin fluid streams are melt drawn in a molten state, i.e. before solidification occurs, to orient the polymer molecules for good tenacity. Typical melt draw down ratios known in the art may be utilized. The skilled artisan will appreciate that specific melt draw down is not required for meltblowing processes.

When a continuous filament or staple process is employed, it may be desirable to subject the strands to a draw process 16. In the draw process the strands are typically heated past their glass transition point and stretched to several times their original length using conventional drawing equipment, such as, for example, sequential godet rolls operating at differential speeds. As is known in the art, draw ratios of about 2 to about 5 times are typical for polyolefin fibers. Optionally, the drawn strands may be heat set, to reduce any latent shrinkage imparted to the fiber during processing, as is further known in the art.

Following drawing in the solid state, the continuous filaments are cut into a desirable fiber length in a staple process 18. The length of the staple fibers generally ranges from about 25 to about 50 millimeters, although the fibers can be longer or shorter as desired. See, for example, U.S. Pat. No. 4,789,592 to Taniguchi et al. and U.S. Pat. No. 5,336,552 to Strack et al. Optionally, the fibers may be subjected to a crimping process prior to the formation of staple, as is known in the art. Crimped composite fibers are highly useful for producing lofty woven and nonwoven fabrics since the microfilaments split from the multicomponent fibers largely retain the crimps of the composite fibers and the crimps increase the bulk or loft of the fabric. Such lofty fine fiber fabric of the present invention exhibits cloth-like textural properties, e.g., softness, drapability and hand, as well as the desirable strength properties of a fabric containing highly oriented fibers.

Figure 4:
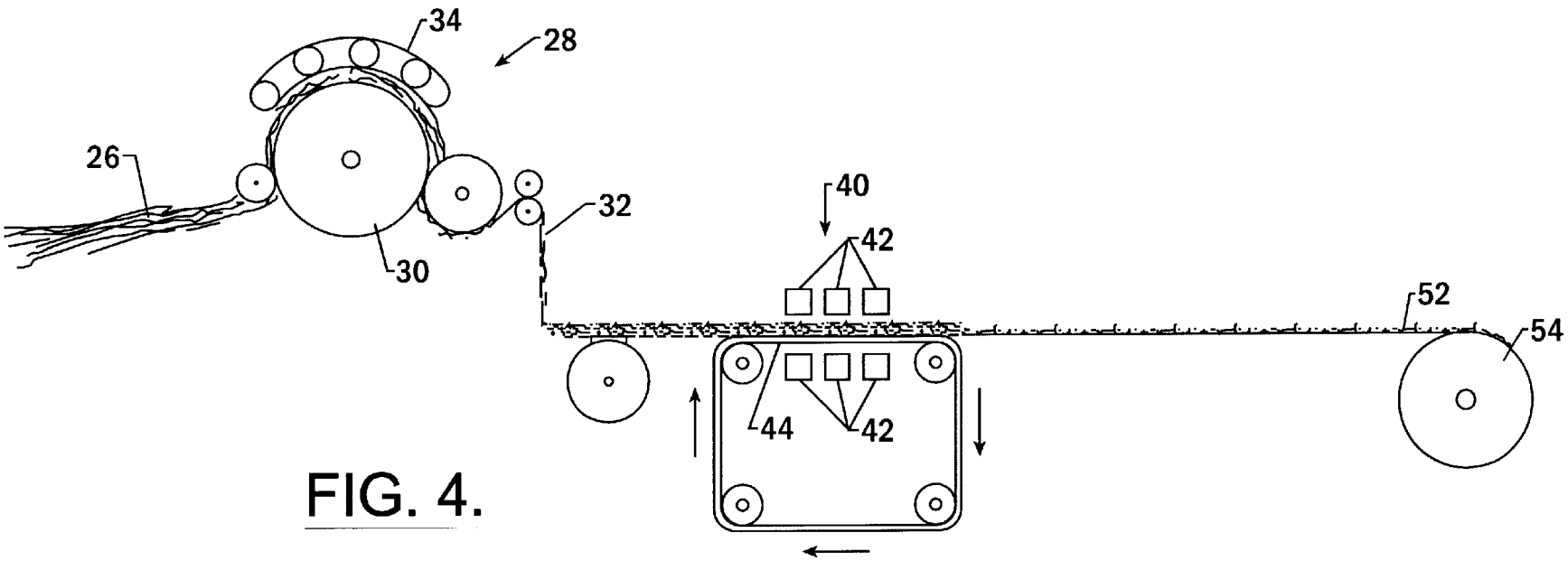
FIG. 4 schematically illustrates one fabric formation process of the invention which includes carding and hydroentangling steps.

The staple fiber thus formed is then fed into a carding process 20. A more detailed schematic illustration of a carding process is provided in FIG. 4. As shown in FIG. 4, the carding process can include the step of passing spun yarns 26 comprising staple fibers through a carding machine 28 to align the fibers of the yarn as desired, typically to lay the fibers in roughly parallel rows, although the staple fibers may be oriented differently. The carding machine 28 is comprised of a series of revolving cylinders 34 with surfaces covered in teeth. These teeth pass through the yarn as it is conveyed through the carding machine on a moving surface, such as a drum 30. The carding process produces a fiber web 32.

Referring back to FIG. 3, in one advantageous embodiment of the invention, carded fiber web 32 is subjected to a fabric formation process to impart cohesion to the fiber web. In one aspect of that embodiment, the fabric formation process includes the step of bonding the fibers of fiber web 32 together to form a coherent unitary nonwoven fabric. The bonding step can be any known in the art, such as mechanical bonding, thermal bonding, and chemical bonding. Typical methods of mechanical bonding include hydroentanglement and needle punching.

In a preferred embodiment of the present invention, a hydroentangled nonwoven fabric is provided. A schematic of one hydroentangling process suitable for use in the present invention is provided in FIG. 4. As shown in FIG. 4, fiber web 32 is conveyed longitudinally to a hydroentangling station 40 wherein a plurality of manifolds 42, each including one or more rows of fine orifices, direct high pressure water jets through fiber web 32 to intimately hydroentangle the staple fibers, thereby providing a cohesive, nonwoven fabric 52.

The hydroentangling station 40 is constructed in a conventional manner as known to the skilled artisan and as described, for example, in U.S. Pat. No. 3,485,706 to Evans, which is hereby incorporated by reference. As known to the skilled artisan, fiber hydroentanglement is accomplished by jetting liquid, typically water, supplied at a pressure of from about 200 psig up to 4000 psig or greater to form fine, essentially columnar, liquid streams. The high pressure liquid streams are directed toward at least one surface of the composite web. In one embodiment of the invention water at ambient temperature and 200 bar is directed towards both surfaces of the web. The composite web is supported on a foraminous support screen 44 which can have a pattern to form a nonwoven structure with a pattern or with apertures or the screen can be designed and arranged to form a hydraulically entangled composite which is not patterned or apertured. The fiber web 32 can be passed through the hydraulic entangling station 40 a number of times for hydraulic entanglement on one or both sides of the composite web or to provide any desired degree of hydroentanglement.

Optionally, the nonwoven webs and fabrics of the present invention may be thermally bonded. In thermal bonding, heat and/or pressure are applied to the fiber web or nonwoven fabric to increase its strength. Two common methods of thermal bonding are air heating, used to produce low-density fabrics, and calendering, which produces strong, low-loft fabrics. Hot melt adhesive fibers may optionally be included in the web of the present invention to provide further cohesion to the web at lower thermal bonding temperatures. Such methods are well known in the art.

In addition, rather than producing a dry-laid nonwoven fabric, an aspect of which was previously described, a nonwoven may be formed in accordance with the instant invention by direct-laid means. In one embodiment of direct laid fabric, continuous filament is spun directly into nonwoven webs by a spunbonding process. In an alternative embodiment of direct laid fabric, multicomponent fibers of the invention are incorporated into a meltblown fabric. The techniques of spunbonding and meltblowing are known in the art and are discussed in various patents, e.g., Buntin et al., U.S. Pat. No. 3,987,185; Buntin, U.S. Pat. No. 3,972,759; and McAmish et al., U.S. Pat. No. 4,622,259. The fiber of the present invention may also be formed into a wet-laid nonwoven fabric, via any suitable technique known in that art.

While particularly useful in the production of nonwoven fabrics, the fibers of the invention can also be used to make other textile structures such as but not limited to woven and knit fabrics. Yarns prepared for use in forming such woven and knit fabrics are similarly included within the scope of the present invention. Such yarns may be prepared from the continuous filament or spun yarns comprising staple fibers of the present invention by methods known in the art, such as twisting or air entanglement.

In one advantageous embodiment of the invention, the fabric formation process is used to dissociate the multicomponent fiber into microfilaments. Stated differently, forces applied to the multicomponent fibers of the invention during fabric formation in effect split or dissociate the polymer components to form microfilaments. The resultant fabric thus formed is comprised, for example, of a plurality of microfilaments 6 and 8 shown in FIG. 2, and described previously. In a particularly advantageous aspect of the invention, the hydroentangling process used to form the nonwoven fabric dissociates the composite fiber. In the alternative, the carding, drawing, or crimping processes previously described may be used to split the multicomponent fiber. Optionally, the composite fiber may be divided after the fabric has been formed by application of mechanical forces thereto. In addition, the multicomponent fiber of the present invention may be separated into microfilaments before or after formation into a yarn.

The fabrics of the present invention provide a combination of desirable properties of conventional fine denier fabrics and highly oriented fiber fabrics. These properties include fabric uniformity, superior chemical resistance and high fiber surface area. The fabrics of the present invention also exhibit highly desirable strength properties, desirable hand and softness, and can be produced to have different levels of loft. In addition to the foregoing benefits, fabric of the present invention may also be uniformly pigmented and economically produced.

Beneficial products can be produced with the fabrics of the present invention, as well. In particular, nonwoven fabrics formed from the multicomponent fibers of the invention are suitable for a wide variety of end uses. In one particularly advantageous embodiment, nonwoven fabric of the instant invention may be used as filtration media. In this embodiment, the microfilaments comprising the nonwoven fabric provide the tensile properties, insensitivity to moisture, and high surface area considered beneficial in filtration media. In addition, nonwoven articles produced in accordance with the invention possess superior chemical resistance and are advantageously used in corrosive environments. Further, the nonwoven articles produced in accordance with the invention retain an electrical charge, a requirement for materials used in electret filters.

Based on the foregoing characteristics, nonwoven fabrics made with the splittable filaments of the instant invention should readily find use as filtration media in a broad range of applications, including use in bag filters, air filters, mist eliminators, and the like. Bag filters are known for use in filtering paints and coatings, especially hydrocarbon-based paints and primers, chemicals, petrochemical products, and the like. Air filters are useful in filtering large or small volumes of air. Small air volume applications include face mask filters. Large volumes of air are advantageously filtered using electret filters. Electret air filters are particularly useful in applications such as furnace filters, automotive cabin filters, and room air cleaner filters. Mist eliminators, used to remove liquid or solid airborne particles, are employed in a wide range of industrial applications generating waste gas streams.

In addition to their utility as a single layer filtration media, the nonwovens of the present invention may find use in layered septum structures, such as those disclosed in U.S. Pat. No. 5,785,725. To increase the porosity of the resulting nonwoven fabric, as well as its insulating capabilities, crimped monocomponent fiber may be included in the fiber web, as described in U.S. Pat. Nos. 4,988,560 and 5,656,368. Optionally, it may be advantageous to alter the critical wetting surface tension of the nonwoven fabric, as described in U.S. Pat. No. 5,586,997.

The fabrics of the invention may be useful in other applications as well, such as, but not limited to, use in oil or other chemical absorption devices.

The present invention will be further illustrated by the following non-limiting example.

EXAMPLE 1

Continuous multifilament melt spun fiber is produced using a bicomponent extrusion system. A sixteen segment pie/wedge bicomponent fiber is produced having eight segments of PMP and eight segments of PP. The weight ratio of PP to PMP in the bicomponent fibers is 70/30. The PP employed is a 18 melt index polyolefin, commercially available as HGZ-180 from Phillips Sumika. The PMP is a 26 melt index polyolefin, commercially available as TPX RT-18 from Mitsui Chemicals. The spinneret temperature is 320° C. and the undrawn fiber is taken up at 900 m/min.

Following extrusion, the filaments are subsequently drawn using a draw ratio of 3.0, thereby yielding a 3 denier multifilament multicomponent fiber. The fiber is then crimped and cut to ½ inch length staple fiber. This staple fiber is carded to form a web that is subsequently hydroentangled using water jets operating at 200 bar pressure. The water jets simultaneously entangle the fibers to give the web strength and split the fibers substantially into individual PMP and PP microfibers. The resulting fabric has a luxurious hand and drape and a small pore size.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation That which is claimed:

1. A mechanically splittable multicomponent fiber having an outer peripheral surface comprising:

at least two polymer components comprising a branched alkyl olefin polymer; and at least two polymer components comprising a straight-chain alkyl olefin polymer, wherein each of said polymer components forms a portion of the outer peripheral surface of said fiber to form distinct unocclusive cross-sectional segments along a length of the fiber so that said components are not physically impeded from being separated from one another.

2. The fiber of claim 1, wherein said branched alkyl olefin polymer comprises a polymer selected from the group consisting of poly(4-methyl-1-pentene), 3-methylbutene-1, 4,4-dimethylpentene-1, and copolymers, terpolymers, and mixtures thereof.

3. The fiber of claim 2, wherein said branched alkyl olefin polymer is poly(4-methyl-1-pentene).

4. The fiber of claim 1, wherein said straight-chain alkyl olefin polymer comprises a polymer selected from the group consisting of polyethylene, polypropylene, poly-1-butene and copolymers, terpolymers, and mixtures thereof.

5. The fiber of claim 4, wherein said straight-chain alkyl olefin polymer is polypropylene.

6. The fiber of claim 1, wherein said fiber is selected from the group consisting of pie/wedge fibers, segmented round fibers, segmented oval fibers, segmented rectangular fibers, and segmented multilobal fibers.

7. The fiber of claim 1, wherein said fiber is selected from the group consisting of continuous filaments, staple fibers, and meltblown fibers.

8. The fiber of claim 7, wherein said fiber is a staple fiber.

9. The fiber of claim 3, wherein the weight ratio of said poly(4-methyl-1-pentene)polymer component to said straight-chain alkyl olefin polymer component ranges from about 80/20 to about 20/80.

10. The fiber of claim 3, wherein said straight-chain alkyl oleo polymer is polypropylene, the weight ratio of said poly(4-methyl-1-pentene)polymer component to said polypropylene component ranges from about 80/20 to about 20/80, and the fiber has a pie/wedge configuration.

11. The fiber of claim 1, wherein said fiber comprises a plurality of polymer segments formed of a branched alkyl olefin polymer alternating with a plurality of polymer segments formed of a straight-chain alkyl olefin polymer.

12. The fiber of claim 11, wherein said fiber is a pie/wedge fiber comprising a plurality of substantially triangular shaped polymer segments formed of a branched alkyl olefin polymer alternating with a plurality of substantially triangular shaped polymer segments formed of a straight-chain alkyl olefin polymer.

13. The fiber of claim 11, wherein said fiber is a segmented round fiber having a round cross-sectional configuration and comprising a plurality of polymer segments formed of a branched alkyl olefin polymer alternating with a plurality of polymer segments formed of a straight-chain alkyl olefin polymer.

14. The fiber of claim 11, wherein said fiber is a segmented rectangular fiber having a rectangular cross-sectional configuration and comprising a plurality of polymer segments formed of a branched alkyl olefin polymer alternating with a plurality of polymer segments formed of a straight-chain alkyl olefin polymer.

15. The fiber of claim 11, wherein said fiber is a segmented oval fiber having an oval cross-sectional configuration and comprising a plurality of polymer segments formed of a branched alkyl olefin polymer alternating with a plurality of polymer segments formed of a straight-chain alkyl olefin polymer.

16. The fiber of claim 11, wherein said fiber is a segmented multilobal fiber.

17. The fiber of claim 16, wherein said segmented multilobal fiber comprises at least three arms extending outwardly from a central region of said fiber, wherein said central region of said fiber comprises one of said branched alkyl olefin polymer or said straight-chain alkyl olefin polymer and each of said arms comprises the other of said branched alkyl olefin polymer or said straight-chain alkyl olefin polymer.

* * * * *

UNITED STATES PATENT AND TRADEMARK OFFICE

CERTIFICATE OF CORRECTION

PATENT NO. : 6,461,729 B1
DATED : October 8, 2002
INVENTOR(S) : Dugan

It is certified that error appears in the above-identified patent and that said Letters Patent is hereby corrected as shown below:

Title page,
Item [56], References Cited, U.S. PATENT DOCUMENTS,
"Helm" should read -- Helms, Jr. et al. --.

Column 13,
Line 16, "oleo" should read -- olefin --.

Signed and Sealed this

Eleventh Day of February, 2003

JAMES E. ROGAN
*Director of the United States Patent and Trademark Office*